United States Patent [19]

Brown et al.

[11] Patent Number: 4,495,994

[45] Date of Patent: Jan. 29, 1985

[54] THERMAL INJECTION AND IN SITU COMBUSTION PROCESS FOR HEAVY OILS

[75] Inventors: Alfred Brown; Wann-Sheng Huang; Yick-Mow Shum, all of Houston, Tex.

[73] Assignee: Texaco Inc., White Plains, N.Y.

[21] Appl. No.: 463,203

[22] Filed: Feb. 2, 1983

[51] Int. Cl.[3] ..... E21B 43/243

[52] U.S. Cl. ..... 166/261; 166/263; 166/272

[58] Field of Search ..... 166/261, 263, 272, 303

[56] References Cited

U.S. PATENT DOCUMENTS

| | | | |
|---|---|---|---|
| Re. 27,252 | 12/1971 | Sklar et al. | 166/263 X |
| 3,360,045 | 12/1967 | Santourian | 166/272 |
| 3,375,870 | 4/1968 | Satter et al. | 166/263 X |
| 3,409,077 | 11/1968 | Durie | 166/272 X |
| 3,563,312 | 2/1971 | Zwicky | 166/263 X |
| 3,680,634 | 8/1972 | Peacock et al. | 166/261 |
| 3,794,113 | 2/1974 | Strange | 166/263 X |
| 3,991,828 | 11/1976 | Allen et al. | 166/261 |
| 4,060,129 | 11/1977 | Gomaa et al. | 166/252 |

FOREIGN PATENT DOCUMENTS

| | | | |
|---|---|---|---|
| 511768 | 8/1939 | United Kingdom | 166/263 |

OTHER PUBLICATIONS

Meldau, Robert F., et al., "Cyclic Gas/Steam Stimulation of Heavy-Oil Wells".

*Primary Examiner*—George A. Suchfield

*Attorney, Agent, or Firm*—Robert A. Kulason; Jack H. Park; Harold J. Delhommer

[57] ABSTRACT

A method is disclosed for recovering hydrocarbons from heavy oil and tar sand formations by a series of sequenced steps, wherein the production wells are initially steam stimulated. Thereafter, about 0.6 to about 1.2 pore volumes of steam of a relatively high steam quality are injected into the formation through the injection wells. An additional quantity of steam is then injected wherein the steam quality is decreased to a relatively low quality. Water injection and wet in situ combustion conclude the method.

13 Claims, 3 Drawing Figures

STEAM FOLLOWED BY COLD WATER
(13.5° API CRUDE)

OIL SATURATION, % Vp
80
60
40
20
0
STEAM
WATER
40 %
80 %
100 %
CELL VOLUME
SWEPT BY STEAM
0
100
200
300
400
TIME, MINUTES

TEMPERATURE DISTRIBUTION VS
SAND PACK LENGTH 108
142 MINUTES
148
181
203
303
0 MINUTES
STEAM
WATER
TEMPERATURE, °C
150°
100°
40°
0°
0
10
20
30
40
50
60
SAND PACK LENGTH, CENTIMETERS

THERMAL INJECTION AND IN SITU COMBUSTION PROCESS FOR HEAVY OILS

FIELD OF THE INVENTION

This invention is related to copending U.S. patent applications, Ser. No. 463,215, filed Feb. 2, 1983, and Ser. No. 463,214, filed Feb. 2, 1983. The present invention concerns an oil recovery method for heavy oils and tar sands wherein injection of steam, steam of decreasing quality and then water is followed by in situ combustion.

BACKGROUND OF THE INVENTION

It is well recognized that primary hydrocarbon recovery techniques may recover only a portion of the petroleum in the formation. Thus, numerous secondary and tertiary recovery techniques have been suggested and employed to increase the recovery of hydrocarbons from the formations holding them in place. Thermal recovery techniques have proven to be effective in increasing the amount of oil recovered from the formation. Water flooding and steam flooding have proven to be the most successful oil recovery techniques yet employed in commercial practice, however, the use of these techniques may still leave up to 60% to 70% of the original hydrocarbons in place, depending on the formation and the quality of the oil.

Furthermore, steam flooding can be a very expensive proposition. The oil remaining in a formation may not be worth the high cost of steam injection and production. This is particularly true for high gravity oil reservoirs, especially those which have been previously subjected to water flooding.

The problem in successfully applying steam flooding to high gravity oil reservoirs is associated with process economics and more particularly with incremental oil saturation. In a traditional steam flood application for a heavy oil holding, a change in oil saturation of up to 0.5 and 0.6 are representative oil recovery targets. This is very difficult to approach without injecting multiple pore volumes of expensive high quality steam. Consequently, investigations have been conducted into possible modifications of steam flooding.

It is old in the art to use lower quality steam in a continuous injection manner. A second method is disclosed in U.S. Pat. No. 3,360,045 wherein steam injection is followed by hot water containing a polymer to increase viscosity. A third process is disclosed in U.S. patent application Ser. No. 392,415, filed June 25, 1982, to a varying temperature oil recovery method for heavy oils. In this process, initial injection is begun with ambient temperature water, followed by water of a gradually increasing temperature until 100° C. is reached, followed by steam of a low quality wherein the steam quality gradually increases, followed by a steam flood with high quality steam.

U.S. patent application Ser. No. 463,214, filed concurrently herewith on Feb. 2, 1983, discloses a fourth method for reducing the total quantity of steam injected. This method advocates the use of a small steam slug sufficient to generate a steam distillation front, followed by a slug of non-condensable gas to prevent steam front collapse upon injection of cold water.

U.S. patent application Ser. No. 463,215, filed concurrently herewith on Feb. 2, 1983, discloses a fifth method for reducing needed steam quantities. This method describes the use of a small steam slug sufficient to generate a steam front (0.1 to 0.6 pore volume), followed by a steam slug wherein the quality of the steam is decreased to a relatively low quality, followed by ambient temperature water injection. All of these processes reduce the cost of a usual steam flood and attempt to get oil recoveries similar to that of full-scale steam floods.

SUMMARY OF THE INVENTION

A method is disclosed for recovering hydrocarbons from heavy oil and tar sand formations by a series of sequenced steps wherein the production wells are initially steam stimulated by the injection of steam followed by a soaking period and production. After steam stimulation, about 0.6 to about 1.2 pore volumes of steam of a relatively high quality are injected into the formation through the injection wells. An additional 0.1 to about 0.6 pore volume of steam is then injected, wherein the quality of the steam is gradually decreased from the relatively high quality of the first steam injection step to a relatively low quality and then to water.

The injection of about 0.5 to about 1.5 pore volumes of water is then followed by the injection of air and the beginning of an in situ combustion process. After the combustion front has propagated about 30 to about 50 feet from the injection well, water is injected along with the air to create a wet in situ combustion process.

DETAILED DESCRIPTION

Figure 1:
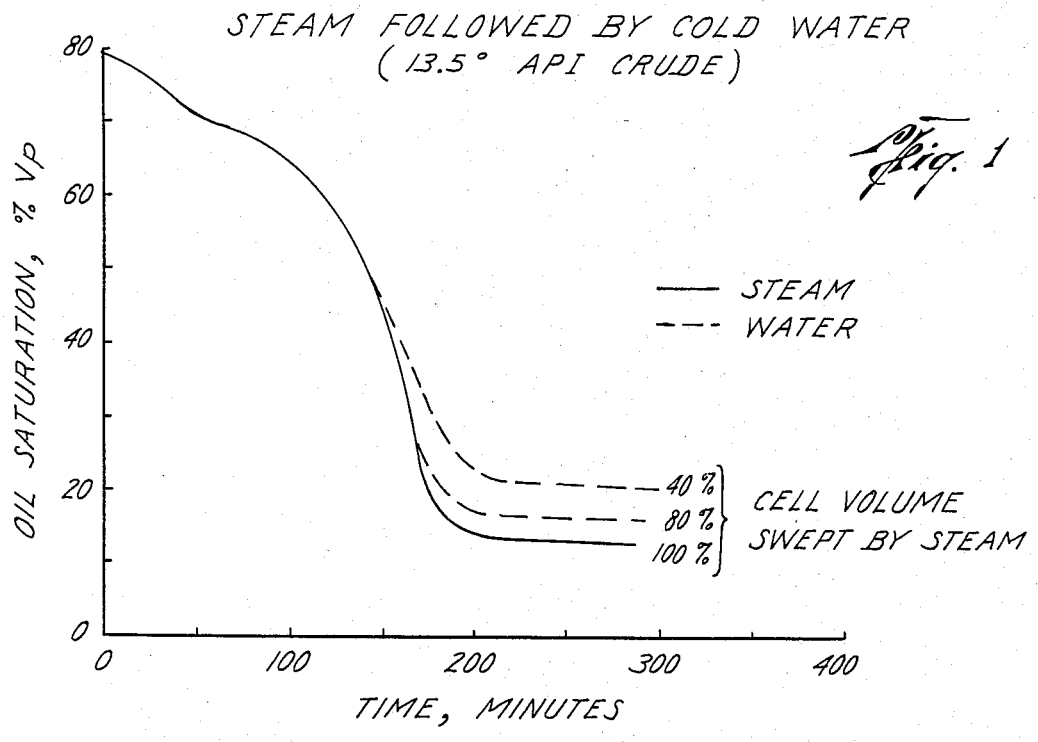
FIG. 1 illustrates the reduction in oil saturation over time for steam floods followed by water injection for a heavy crude of 13.5° API.

The present invention provides a method for achieving oil recoveries and residual oil saturations in heavy oil and tar sand reservoirs similar or greater to that of a full scale steam flood at only a fraction of the cost of such a steam flood. This is done through the combination of initial steam stimulation of the producing wells, followed by steam injection, water and concluding with wet in situ combustion at the injection well. As a result, it is not necessary to inject more than a portion of the quantity of steam that is required for equivalent recoveries in such heavy oil reservoirs. This translates into direct cost savings since less high cost, high quality steam is employed. Expensive steam generating equipment can also be released sooner for use in other areas of the field or other formations.

The first step of the injection sequence involves the injection of steam through the production well or wells at a rate compatible to the reservoir and well bore conditions. It is desirable that all the designated production wells be initially stimulated with a huff-puff (push-pull) steam process. High quality steam is injected into the production wells and allowed to soak. Thereafter, the production wells are produced.

The second step of the injection sequence involves the injection of steam through the injection well or wells at a relatively high quality. It is desirable that the steam quality be greater than about 75%, preferably 100%. Steam of a relatively high quality is required to establish an efficient steam front to sweep the heavy oil or tar sand formation.

About 0.6 to about 1.2 pore volumes of high quality steam, preferably about 0.6 to about 0.8 pore volume is injected through the injection wells in this step. For tar sands, it is preferred to inject about 0.7 to about 1.0 pore volume of steam. About 0.6 to about 0.8 pore volume steam is preferred for non-tar sand, heavy oil formations. Heavy oil is defined as oil having an API gravity of 20° or less.

The injection of high quality steam should continue past steam breakthrough at the production wells until the steam cut in the produced fluids is about 10% to about 30%. Beyond this point, the thermal efficiency measured in BTUs per barrel of produced oil will become economically less favorable. The time required for completion of the steam injection phase will vary considerably, depending upon formation characteristics, pattern size, injection rates and injection pressures. A smaller quantity of steam is needed for formations containing live oils, those oils which contained dissolved gas.

During the high quality steam injection phase, significant amounts of light crude components will be separated from the bulk of the oil by the mechanism of steam distillation. The steam distilled components will form a condensate bank concentrated immediately in front of the steam zone. The bank is composed most of light end hydrocarbons and builds itself into an in situ generated miscible solvent bank which may occupy as much as about 2 percent to about 4 percent of pore volume. A steam distilled condensate bank of this type may approach 100% displacement efficiency.

To help establish communication paths from the injection to the production wells, the production wells should be maintained in a pumped-off condition after initial steam stimulation by a huff-puff process. This will reduce back-pressure and prevent the accumulation and possible plugging of the production wells by viscous oil.

The third step begins immediately after the high quality steam injection step and involves the gradual tapering of steam quality from the relatively high quality of the first injection step to a steam quality of less than about 20 percent, preferably 0% steam quality. The tapering of the steam quality occurs in a preferably linear fashion over about 0.1 to about 0.6 pore volumes, preferably about 0.2 to about 0.5 pore volume. This procedure will normally maintain the steam distilled solvent bank integrity and prevent steam front collapse with its disastrous effects of lowered production and possible backflow into areas previously vacated by the steam.

Eventually, the tapered steam injection will become hot water injection at 0% steam quality. In fact, water will be injected throughout the tapered steam injection step to lower the quality of the steam. This maximizes heat energy utilization and permits the water to scavenge heat from the previously heated thermal zones. Steam generation equipment is also released sooner for use in other areas of the field.

The reduction in steam quality must be gradual and the injection rate must be increased, if necessary, to maintain the injection pressure. It is important that the pressure gradient in the reservoir be maintained to prevent any resaturation of the previously steam flooded zone. Thus, during the gradual transition to lower quality steam, injectivity of the formation and the fluid produced should be constantly monitored to determine if the pressure, quality or quantity of the injected fluid should be modified. If an untenable injectivity loss occurs during the steam transition step or the injection of water at 0% steam quality, steam injection should be resumed. If injectivity problems continue to occur, other restorative measures such as the use of anti-dispersion additives, mud acids or clay stabilizers may be necessary.

Moreover, the tapering of steam quality down to 0%, where the steam injection becomes 100% water injection, will not only gradually heal any paths of steam override, but will also improve vertical conformance. Steam override can become a serious problem if formation thickness is greater than 50 feet and the well spacing is about five acres or larger. Decreasing steam override can result in substantial additional oil recoveries.

After the tapering of steam quality to preferably 0%, about 0.5 to about 1.5 pore volumes of water are injected into the injection well. Water of any temperature may be injected. Hot water is generally more effective, but certainly more costly than water at an ambient temperature. A balance must be struck between the temperature of the water and the desired recovery efficiency. Water temperature may vary from ambient temperature to 100° C. However, it is preferred that the water temperature be maintained between about 80° to 100° C. for tar sands since most tar sands will not flow at temperatures below the preferred range. Optimum water temperature may vary considerably for various heavy oil reservoirs.

The tapering of steam quality followed by water will provide a liquid-filled reservoir with optimum temperature and pressure conditions for in situ combustion, prior to the initiation of air injection. An igniter is preferably used to initiate the in situ combustion along with the injection of air. Usually, the igniter is removed from the formation after ignition. After a stable in situ combustion front has propagated approximately 30 to 50 feet from the air injection well, a wet in situ combustion process is preferably initiated by comingling the injected air with water. The water/air ratio should initially be in the range of about 0.05 barrels of water/1000 $ft^3$ of air to about 0.25 barrels of water/1000 $ft^3$ of air.

The amount of comingled water injected should be gradually increased from the initial ratio with air to 100% water without air prior to combustion floodout. As a general guideline, at least 50 percent of the reservoir should be burned by the in situ combustion front prior to increasing the water/air ratio. This should occur prior to the steam plateau reaching the producing wells. The steam plateau is the steam zone pushed ahead of the in situ combustion front. The increase in the water/air ratio is preferably a linear increase. Laboratory experiments have shown that potential oil recovery is in the range of about 70 percent to about 90 percent of the original oil in place using the proposed combination of thermal recovery processes and wet in situ combustion.

The quantity of fluid injected during each step and the decision on when to change from one injection step to another is dependent upon many factors and varies considerably from formation to formation. A few of the factors which must be considered in determining the length of the injection stages are the type of oil in the formation and the manner in which it reacts to steam distillation, the pore volume and porosity of the field, the stability and character of the injection pressure, trends in injection pressure, the vertical conformance of the recovery process, and production characteristics including the rate of production from the formation and the temperature response at the production well.

FIG. 1 illustrates the reduction in oil saturation for steam and steam/water floods in a linear sand pack. The oil used in each flood was a 13.5° API gravity crude from a Southern California field. The floods were carried out in a 61 cm long, 5.7 cm in diameter, linear sand pack. The sand pack was prepared by saturating the sand with water and then displacing the water with the 13.5° API oil to an oil saturation of 0.80 and a water saturation of 0.20. Porosity was 36% and permeability of the sand pack was about 2000 millidarcies. The steam injection rate was 2 $cm^3$/min and the water injection rate was 4 $cm^3$/min.

The two steam-water floods were conducted by sweeping the specified percentage of the sand pack length with steam, followed by water injection at twice the steam injection rate. Although total recovery was lower for the steam-water injection sequences, recovery economics were considerably better due to the decreased cost of the steam-water floods.

Figure 2:
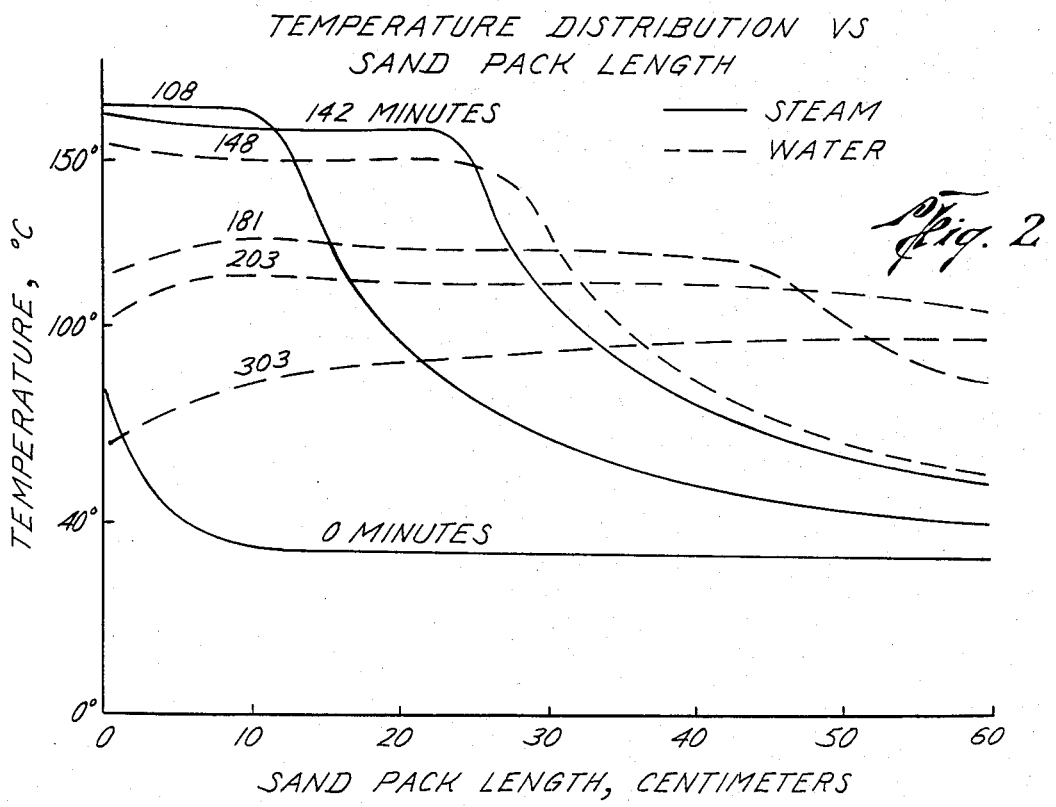
FIG. 2 illustrates the temperature distribution over the length of the sand pack for the first flood of FIG. 1, wherein 40% of the cell volume was swept by steam.

FIG. 2 represents the temperature distribution of the steam-water flood shown in FIG. 1, wherein 40% of the sand pack length was swept by steam at 2 $cm^3$/min followed by ambient temperature water injection at 4 $cm^3$/min. It is evident from FIG. 2 that heat was scavenged from behind the steam front and moved forward to the end of the sand pack by the injected water. Laboratory results also indicated that there was a continuous movement of the steam front after initiation of water injection because the water phase behind the steam front continued to evaporate due to pressure fall-off. Fill-up was also at a minimum because a pumped-off condition was simulated with the sand pack flood.

Figure 3:
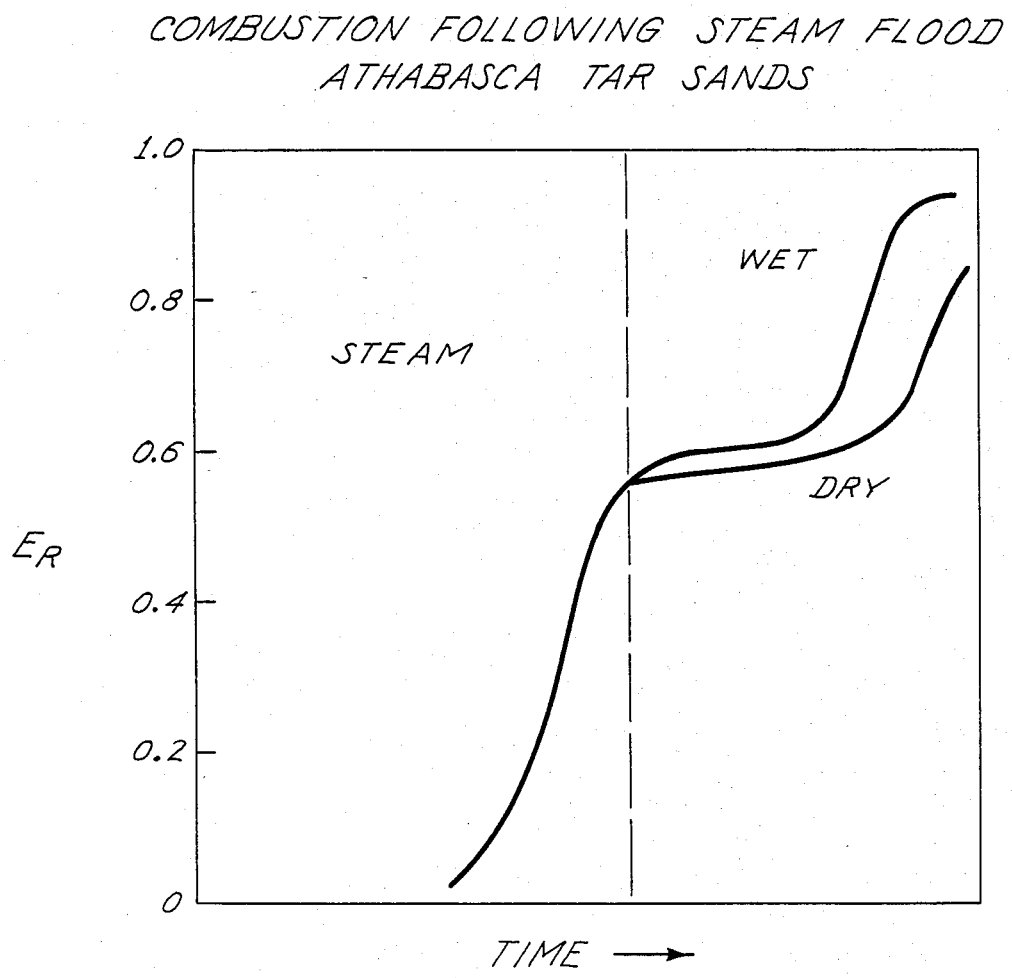
FIG. 3 illustrates relative recovery efficiencies for wet and dry in situ combustion following steam flooding in Athabasca tar sands.

FIG. 3 illustrates oil recovery efficiencies for wet and dry in situ combustion after steam flooding for Athabasca tar sands. Data for FIG. 3 was developed from horizontal combustion tube tests. The combustion tubes were packed with Athabasca tar sand material with the crude having an API gravity of about 8°. Initial oil saturation was 0.71.

Steam was injected into the sand face at 216° C., 300 psig and 100% steam quality. After steam breakthrough, steam injection was stopped and air injection was begun. Combustion was spontaneous within thirty minutes after air injection. The process recovered 92% of the original oil-in-place, with 56% of the original oil recovered by steam.

Comparison tests with dry in situ combustion under similar conditions indicated that the wet in situ combustion process performed substantially better than the dry in situ combustion method in terms of greater and earlier oil recovery. Fuel and air requirements were also substantially lower with the wet in situ process. These requirements, which comprise a significant portion of the overall cost of an in situ project, also decreased with an increasing water to air ratio. With wet in situ combustion combined with the initial thermal recovery steps proposed herein, the present invention offers similar or greater oil recoveries than a full scale steam flood at a significantly lower cost.

Many other variations and modifications may be made in the concept described above by those skilled in the art without departing from the concept of the present invention. Accordingly, it should be clearly understood that the concepts disclosed in the description are illustrative only and are not intended as limitations on the scope of the invention.

What is claimed is:

1. A method for stimulating the production of hydrocarbons from a subterranean heavy oil or tar sand formation penetrated by an injection well and a production well, which comprises:

(a) stimulating the production well by injecting steam into the production well, shutting in the production well and then producing the well;

(b) injecting about 0.6 to about 1.2 pore volumes of steam having a quality greater than about 75% into the injection well;

(c) after injection of greater than 75% quality steam, injecting about 0.1 to about 0.6 pore volume of steam into the injection well while gradually decreasing the quality of the steam from its initial quality of greater than about 75% to a quality less than about 20%;

(d) after injection of decreasing quality steam, injecting about 0.5 to about 1.5 pore volumes of water into the injection well;

(e) after water injection, injecting air into the formation and creating an in situ combustion front; and (f) injecting water into the formation along with the air after the combustion front has propagated about thirty to about fifty feet from the point of injection.

2. The method of claim 1, wherein more than one injection well is employed.

3. The method of claim 1, wherein more than one production well is employed.

4. The method of claim 1, wherein the production well is maintained in a pumped-off condition after steam stimulation.

5. The method of claim 1, wherein the injection of steam having a quality of at least 75% is continued until the steam cut in the produced fluids reaches about 10% to about 30%.

6. The method of claim 1, wherein water is initially injected with air in the combustion step in the ratio of about 0.05 barrels of water per 1000 cubic feet of air to about 0.25 barrels of water per 1000 cubic feet of air.

7. The method of claim 6, wherein the ratio of water to air in the combustion process is gradually increased until air is no longer injected.

8. The method of claim 7, wherein the water to air ratio is not increased until the combustion front has burned over fifty percent of the formation.

9. The method of claim 1, wherein about 0.6 to about 0.8 pore volume of steam is initially injected into the injection well for a non-tar sand, heavy oil reservoir.

10. The method of claim 1, wherein about 0.7 to about 1.0 pore volume of steam is initially injected into the injection well for a tar sand reservoir.

11. The method of claim 1, wherein the steam first injected into the injection well has a quality of 100%.

12. The method of claim 1, wherein the steam quality less than about 20% is 0%.

13. A method for stimulating the production of hydrocarbons from a subterranean heavy oil or tar sand formation penetrated by an injection well and a production well, which comprises:

(a) stimulating the production well by injecting steam into the production well, shutting in the production well and then producing the well;

(b) maintaining the production well in a pumped-off condition after initial steam stimulation;

(c) injecting about 0.6 to about 1.0 pore volume of steam having a quality of about 80 percent to about 100 percent into the injection well;

(d) after injection of 80 to 100 percent quality steam, injecting about 0.2 to about 0.5 pore volume of steam into the injection well while gradually decreasing the quality of the steam from about 80 percent to about 100 percent initial quality to about 0 percent steam quality;

(e) after injection of decreasing quality steam, injecting about 0.5 to about 1.5 pore volumes of water into the injection well;

(f) after water injection, injecting air into the formation and creating an in situ combustion front;

(g) injecting water into the formation along with the air after the combustion front has propagated about thirty to about fifty feet from the point of injection in a water/air ratio of about 0.05 barrels of water/1000 $ft^3$ of air to about 0.25 barrels of water/1000 $ft^3$ of air; and (h) increasing gradually the water/air ratio in the combustion process after the combustion front has burned over fifty percent of the reservoir until air is no longer injected.

* * * * *